US005184731A

United States Patent [19]

Robertson et al.

[11] Patent Number: 5,184,731

[45] Date of Patent: Feb. 9, 1993

[54] SPIRAL SEPARATOR WITH IMPROVED SEPARATION SURFACE

[75] Inventors: Michael D. Robertson, Jacksonville Beach; Robert M. Carver, Starke, both of Fla.

[73] Assignee: Carpco, Inc., Jacksonville, Fla.

[21] Appl. No.: 631,656

[22] Filed: Dec. 21, 1990

[51] Int. Cl.[5] ..... B03B 5/52

[52] U.S. Cl. ..... 209/459; 209/697

[58] Field of Search ..... 209/459, 460, 485, 697, 209/434

[56] References Cited

U.S. PATENT DOCUMENTS

| | | | |
|---|---|---|---|
| 629,595 | 7/1899 | Pardee | 209/691 X |
| 840,354 | 1/1907 | Lyle | 209/697 X |
| 2,094,957 | 10/1937 | Pardee | 209/697 |
| 3,016,138 | 1/1962 | Le Baron et al. | 209/459 X |
| 4,505,811 | 3/1985 | Griffiths et al. | 209/211 X |
| 4,597,861 | 7/1986 | Wright | 209/459 |
| 4,795,553 | 1/1989 | Giffard | 209/459 |

FOREIGN PATENT DOCUMENTS

| | | | |
|---|---|---|---|
| 84/2673 | 8/1986 | South Africa . | |
| 0299261 | 4/1971 | U.S.S.R. | 209/459 |
| 0874188 | 10/1981 | U.S.S.R. | 209/459 |

*Primary Examiner*—Donald T. Hajec

*Attorney, Agent, or Firm*—Arthur G. Yeager

[57] ABSTRACT

A spiral trough separator for treating a slurry of ore particles in water to separate heavier fines from other particles includes a helical trough making a plurality of revolutions around a vertical axis and having the surface of the trough modified with protuberances to agitate the ore particles to allow entrapped impurities to be liberated and grooves to provide enhanced flow of the finer heavier ore fines closer to such axis to increase the efficiency of the recovery.

18 Claims, 2 Drawing Sheets

SPIRAL SEPARATOR WITH IMPROVED SEPARATION SURFACE

BACKGROUND OF THE INVENTION

Vertical helical or spiral ore separators have been known for the use of concentrating heavy mineral particles and separating them from lighter rock particles. Typical of such separators are those shown in U.S. Pat. Nos. 629,595, 840,354 and 4,597,861; and in South African Patent Application No. 842,673 filed Nov. 4, 1984. None of these provides a high quality separation due principally to the failure to agitate the slurry and its particles sufficiently to cause good lateral movement across the width of the slurry conduit perpendicular to the direction of travel of the slurry.

It is an object of this invention to provide an improved helical ore separator. It is another object of this invention to provide an improved helical ore separator having a modified flow surface. Still other objects will become apparent from the more detailed description which follows.

BRIEF SUMMARY OF THE INVENTION

This invention relates to a vertical axis helical trough separator having 3–10 revolutions about said axis, a feed end at the top of said separator and a discharge end at the bottom of the separator, the trough having an internal concave surface adapted to direct the flow of a slurry of solid particles in a liquid medium in a downward helical path, the surface containing a plurality of upwardly projecting spaced protuberances to agitate the ore particles thus permitting entrapped impurities interspersed with the heavier fines to be released. Preferably a plurality of downwardly projecting spaced grooves at selected locations between the feed end and the discharge end spacedly follows the protuberances.

In preferred embodiments of the invention the helical trough has 4–8 revolutions in its length with the middle revolutions being provided with a plurality of protuberances and spiral grooves in the flow path of the slurry, and the upper and lower revolutions having a smooth surface in the flow path of the slurry.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The invention can best be understood by reference to the attached drawings.

Figure 1:
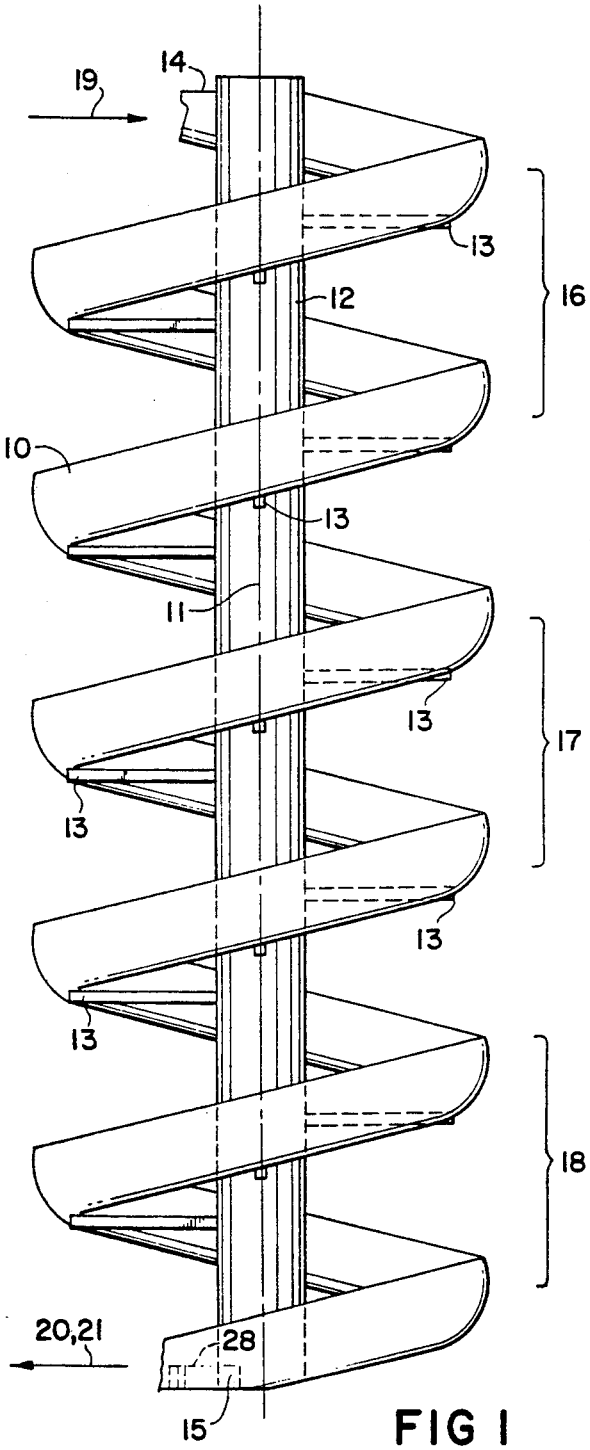
FIG. 1 is a front elevational view of the separator of this invention.
Figure 2:
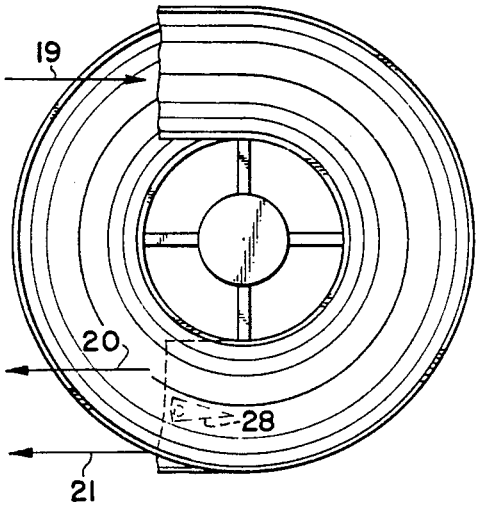
FIG. 2 is a top plan view of the separator of this invention.
Figure 3:
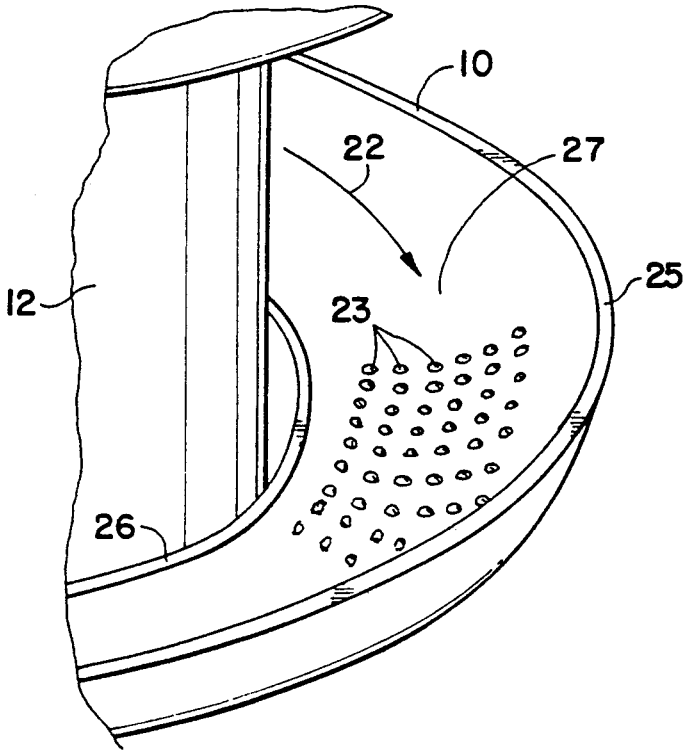
FIG. 3 is a perspective schematic view of a portion of the helical trough showing protuberances in the flow path of the slurry.
Figure 4:
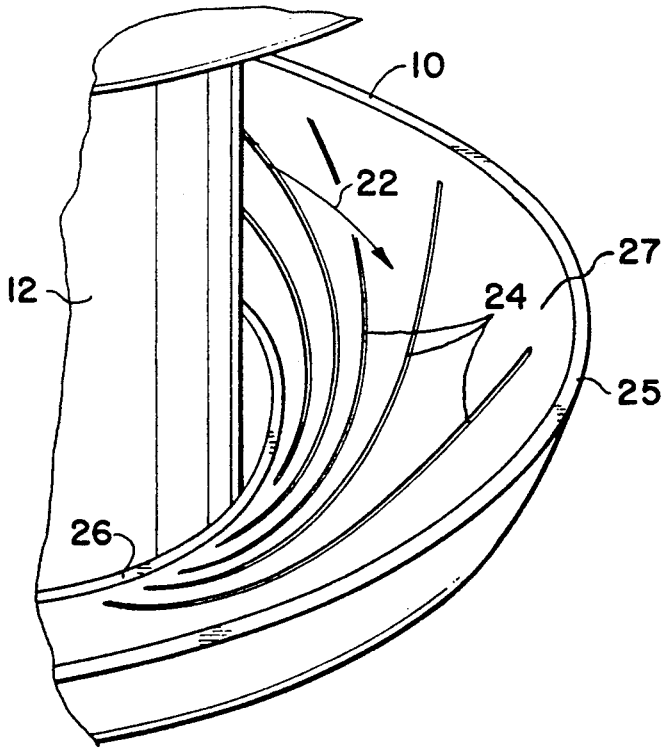
FIG. 4 is a perspective schematic view of a portion of the helical trough showing spiral grooves in the flow path of the slurry.

The separator as seen in FIGS. 1–2 is a vertical helical trough 10 symmetrical about vertical axis 11 and including 4–8 revolutions around vertical axis 11 from the upper feed end 14 to the lower discharge end 15. In general this is used to concentrate the higher specific gravity mineral particles in an aqueous slurry of ore particles introduced at feed end 14 and allowed to flow downwardly by gravity to discharge end 15 where the heavier particles will concentrate closer to axis 11 and lighter particles will concentrate farther away from axis 11. Thus the product can be represented by a first stream at arrow 20 representing the heavier mineral particles and a second stream at arrow 21 representing the lighter weight gauge particles that may be discarded or recirculated. A splitter means 28 may also be employed to direct the streams to different outlets, as is common in the art.

The helical trough 10 may be supported in any manner appropriate for the purpose, such as that shown here of a column 12 and/or a plurality of supporting arms 13 extending radially outward from column 12 and attached at their distal ends to trough 10. Trough may be made in any size which will handle the separations required. Generally a size of between 4 and 12 feet vertical length and 2–3 feet in trough diameter with 4–8 revolutions in the total length is sufficient for most purposes.

The principal features of this invention lie in the surface modifications of the flow path of trough 10. The concave internal surface 27 of trough 10 which serves as the conduit for the slurry may be modified by a plurality of small upwardly projecting protuberances 23, such as hemispheres of $\frac{1}{4}$ to $\frac{1}{2}$ inch in diameter or by a plurality of spiral grooves 24 projecting downwardly in the internal surface 27, e.g., 0.01 to 0.05 inch wide and deep. Generally, the protuberances 23 extend laterally across the flow path of the slurry (radially with respect to axis 11), and if they are small, separate protuberances, are spaced apart in checkerboard arrangement (diamond formation) so as to prevent any unobstructed spiral channels in the direction of flow as indicated by arrow 22. Grooves 24 are arranged in a spiral direction so as to direct the flow of the slurry and its ore particles toward axis 11. Thus, the flow tends to be directed away from outer edge 25 of trough 10 and towards inner edge 26 of trough 10. The direction of grooves 24 is not parallel to outer edge 25 but is in a spiral cutting across flow direction 22 toward the inner edge 26. The surface modification of projecting protuberances tends to improve separation by agitating the ore particles and allowing entrapped impurities to be further liberated and the spiral grooves influence the flow of the finer heavier particles closer to vertical axis 11 improving recovery.

The pattern of individual protuberances 23 and grooves 24 may be varied to suit individual ore samples.

The vertical pattern of surface modifications can also be varied to suit particular conditions. Thus, a preferred arrangement is for upper portion 16 to be 1–3 revolutions of the helical trough 10, middle portion 17 to be 1–3 revolutions of the helical trough 10 and the lower portion 18 to be 1–3 revolutions of helical trough 10. Preferably, in middle portion 17 the surface modifications are protuberances 23 and grooves 24, with the upper portion 16 and lower portion 18 being smooth and free of any modifications.

In certain circumstances, it may be desirable, depending on many factors including the density of the slurry and the materials to be separated, also to provide protuberances and/or grooves in some parts of upper portion 16 and some parts of lower portion 18. For example, protuberances and/or grooves may be positioned in the lower parts of upper portion 16 and/or the upper parts of the lower portion 18 to obtain more efficient separation. In any event there always should be a beginning part of upper portion 16 and an ending part of lower portion 18 that is smooth and free of protuberances and/or grooves, In certain circumstances in any part of the spiral trough separator where protuberances and grooves are both used, the protuberances should be upstream and the grooves downstream, respectively, of each other. This can be maintained whether there is only one section of protuberances followed by a section of grooves, or whether there is a series of such protuberances followed by grooves; the section farthest downstream being grooves.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A vertical axis spiral trough separator having 3–10 revolutions about said axis, a feed end at the top of said separator and a discharge end at the bottom of said separator, said trough having an internal concave surface adapted to direct the flow of a slurry of solid particles in a liquid medium in a downward helical path, said surface containing a plurality of upwardly projecting and spaced protuberances at selected locations between said feed end and said discharge end, said separator having an upper portion, a middle portion, and a lower portion, said middle portion including about 1–6 revolutions of said trough wherein said internal concave surface contains said protuberances, and said upper and lower portions each include about 1–2 revolutions of said trough in which said internal concave surface is smooth and free of any said protuberances.

2. The separator of claim 1 wherein said protuberances are located generally medially of a width of said trough.

3. The separator of claim 1 further comprising a plurality of downwardly projecting grooves at other selected locations in said surface of said trough.

4. The separator of claim 3 wherein said lower portion of said trough is free of said grooves.

5. The separator of claim 3 wherein said upper portion of said trough is free of said grooves.

6. The separator of claim 3 wherein said middle portion contains a plurality of said protuberances and said grooves.

7. The separator of claim 3 wherein said grooves are located downstream in said path from said protuberances.

8. The separator of claim 3 wherein said grooves are spirally arranged to direct said slurry toward said axis.

9. A vertical axis spiral trough separator adapted to receive and conduct by gravity in a downward helical path a slurry of water and particles of an ore and to recover a stream of said slurry containing concentration of heavy said particles and another stream of said slurry containing lighter said particles, said separator comprising a trough arranged in a helix about a vertical axis with 3–10 revolutions in said helix, said separator having a feed end at the upper extremity of said helix and a discharge end at the lower extremity of said helix, said helical trough including an upper portion having about 1–2 said revolutions adjacent said feed end, a lower portion having about 1–2 said revolutions adjacent said discharge end; and a middle portion located between said upper portion and said lower portion and including about 1–6 said revolutions, said trough having an internal concave surface for conducting said slurry in said helical downward path, said surface being modified at selected locations along said path with a plurality of small protuberances projecting upwardly from the surface and arranged laterally across said path to agitate said particles, and said discharge end including splitter means to direct said stream and said another stream to different outlets.

10. The separator of claim 9 wherein said middle portion includes said internal concave surface modified with said protuberances, and said upper and lower portions include said internal concave surface which is smooth and free of said protuberances.

11. The separator of claim 9 wherein said lower portion of said trough has a smooth internal concave surface free of said protuberances.

12. The separator of claim 9 wherein said upper portion of said trough has a smooth internal concave surface free of said protuberances.

13. The separator of claim 9 further comprising a plurality of downwardly projecting shallow grooves at other selected locations in said surface of said trough arranged in a spiral direction to direct flow of said slurry generally toward said axis.

14. The separator of claim 13 wherein said middle portion includes said internal concave surface modified with said protuberances and with said grooves.

15. The separator of claim 13 wherein said lower portion of said trough has s smooth internal concave surface free of said protuberances and said grooves.

16. The separator of claim 13 wherein said upper portion of said trough has a smooth internal concave surface free of said protuberances and said grooves.

17. The separator of claim 13 wherein said grooves are located downstream in said path from said protuberances.

18. A vertical axis spiral trough separator adapted to receive and conduct by gravity in a downward helical path a slurry of water and particles of an ore and to recover a stream of said slurry containing a concentration of heavy said particles and another stream of said slurry containing lighter said particles, said separator comprising a trough arranged in a helix about a vertical axis with 3–10 revolutions in said helix; said separator having a feed end portion of 1–2 revolutions at the upper extremity of said helix and a discharge end portion of 1–2 revolutions at the lower extremity of said helix, said trough having a middle portion located between said feed end and discharge end portions, said trough further having an internal smooth concave surface for conducting said slurry in said helical downward path, said surface being modified at selected spaced locations along said path only in said middle portion with a plurality of small separate protuberances projecting upwardly from the surface and spacedly arranged laterally across and along said path to agitate said particles, and said discharge end portion including splitter means to direct said stream and said another stream to different outlets.

* * * * *